US005743291A

United States Patent [19]

Nehm et al.

[11] Patent Number: 5,743,291

[45] Date of Patent: Apr. 28, 1998

[54] SANITARY SAFETY DEVICE

[75] Inventors: Holger Nehm, Mullheim; Christoph Weis, Lorrach, both of Germany

[73] Assignee: Dieter Wildfang GmbH, Mullheim, Germany

[21] Appl. No.: 790,752

[22] Filed: Jan. 27, 1997

[30] Foreign Application Priority Data

Jan. 31, 1996 [DE] Germany ..... 196 03 393.4

[51] Int. Cl.[6] ..... F16K 25/00

[52] U.S. Cl. ..... 137/454.2; 251/120; 137/543; 138/46

[58] Field of Search ..... 138/45, 46; 137/454.2, 137/542, 543; 251/120

[56] References Cited

U.S. PATENT DOCUMENTS

| | | | |
|---|---|---|---|
| 2,568,519 | 9/1951 | Smith | 138/45 |
| 2,804,281 | 8/1957 | Osburn | 137/454.2 |
| 3,347,266 | 10/1967 | Hansen | 137/454.2 |
| 3,442,288 | 5/1969 | Scaramucci | 137/543 |
| 3,847,178 | 11/1974 | Keppel | 138/46 |
| 4,296,778 | 10/1981 | Anderson | 137/454.2 |
| 4,344,459 | 8/1982 | Nelson | 138/45 |
| 4,562,960 | 1/1986 | Marty | 138/45 |
| 5,226,445 | 7/1993 | Surjaatmadja | 137/542 |
| 5,522,197 | 6/1996 | Ebeling | 138/45 |

FOREIGN PATENT DOCUMENTS

| | | |
|---|---|---|
| 566813 | 9/1972 | European Pat. Off. . |
| 8528344 | 1/1986 | Germany . |
| 3820837 | 1/1990 | Germany . |

OTHER PUBLICATIONS

"Wasser formen" catalog 1991 pp. 24–26 Dieter Wildfang GmbH.

"Wasser Sichern" catalog 1992 pp. RV1–12/91 & RV2 3/92 Dieter Wildfang GmbH.

*Primary Examiner*—Denise L. Ferensic
*Assistant Examiner*—Ramyar Farid
*Attorney, Agent, or Firm*—Dallett Hoopes

[57] ABSTRACT

The invention relates to a sanitary safety device which is interposed in a water-supply line and there is insertable in an opening in the region of a coupling point or joint. It is characteristic of the sanitary safety device according to the invention that the sanitary safety device has a flow regulator (2) or similar restrictor as well as a backflow preventer (3), these being combined in the sanitary safety device to compose a constructional unit in the form of a cartridge (1). Such is insertable for example, in the opening of a recess in the form of a cartridge mount provided in a hose connector. The cartridge (1) composed of the flow regulator (2), backflow preventer (3) and any strainer attachment (8) at the inflow end can thus be interposed in a water-supply line in a simple fashion and with little effort.

7 Claims, 7 Drawing Sheets

SANITARY SAFETY DEVICE

Figure 1:
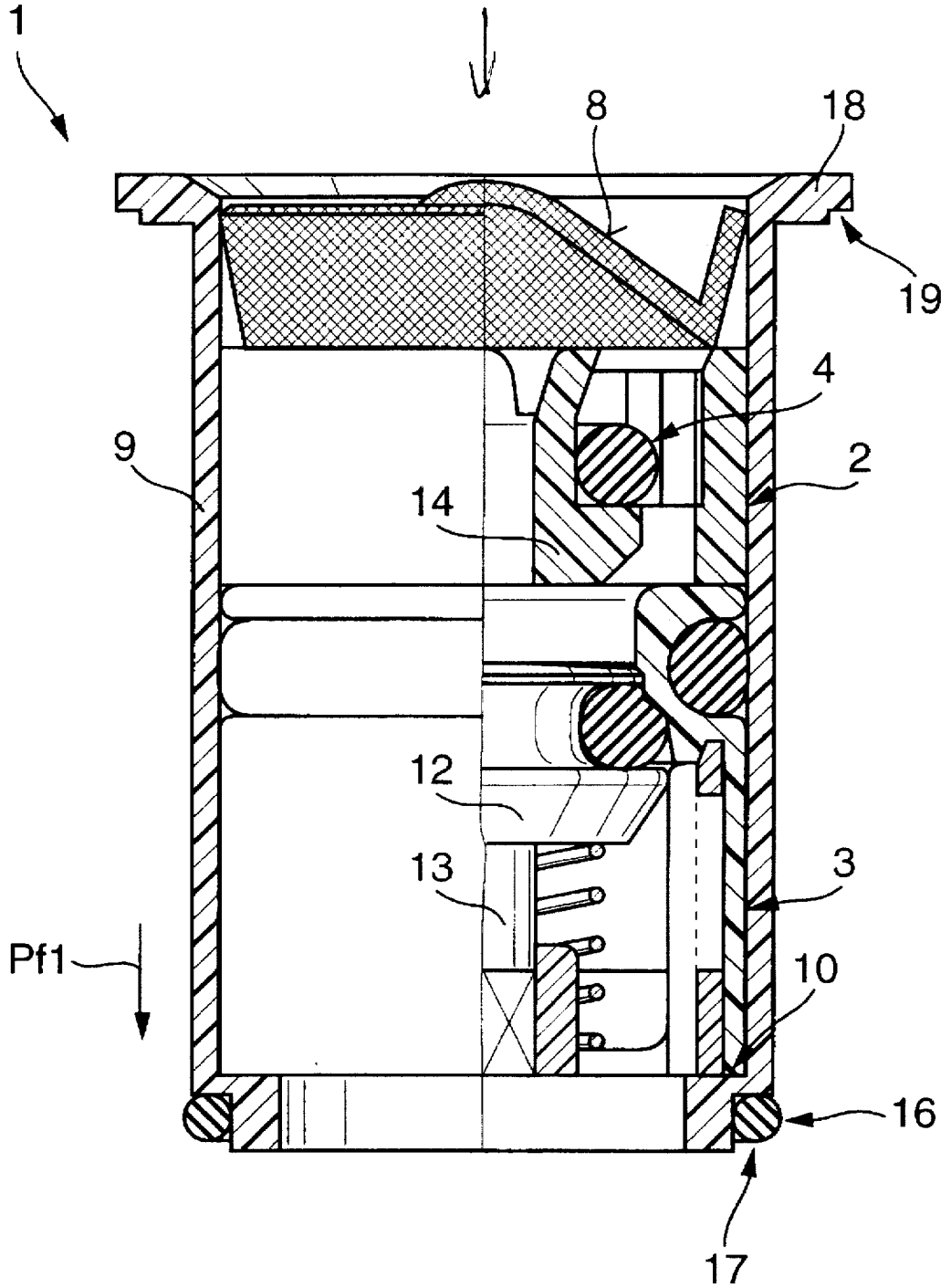

The invention relates to a sanitary safety device which is interposed in a water-supply line and there is insertable in an opening in the region of a coupling point or joint.

From EP 0 566 813 a flexible water hose is already known whose hose connector has in its opening a recess in which a flow restrictor is insertable. Since the known water hose already has a flow restrictor in its hose connector, such a restrictor can be dispensed with in the vicinity of faucets and mixers where it is liable to affect their structure and to lead to difficulties in manufacture, fitting and use.

The known flow restrictor is also usable in conjunction with a backflow preventer. However, the adaptation of the recess provided in the hose connector to the longitudinal extent of the flow restrictor on the one hand, and backflow preventer on the other, determines the functions of the known water hose. In addition, when fitting the hose, the flow restrictor and backflow preventer have to be inserted singly in the recess in a complicated way, potentially involving fitting errors and considerable extra effort.

The object underlying the invention is therefore in particular to provide a sanitary safety device of the kind mentioned at the outset, which can be interposed in a water-supply line in a simple fashion and with as little effort as possible.

This object is accomplished according to the invention in the sanitary safety device particularly in that the sanitary safety device has a flow regulator, flow restrictor or similar control as well as at least one backflow preventer, these being combined in the sanitary safety device to compose a constructional unit in the form of a cartridge.

In the safety device embodying the invention, a flow regulator or the like is combined with at least one backflow preventer to compose a constructional unit which takes the form of a cartridge or cartouche and is insertable in a simple fashion and with little effort in an opening at the coupling point or joint of a water-supply line. Fitting errors can be counteracted by appropriate design of the cartridge housing and/or by appropriate marking on its peripheral casing.

The cartridge not only combines the advantages of the components it comprises, namely the water saving effect of the flow regulator and the prevention of backflow of contaminated used water into the pipe system, particularly in the region of flexible water hoses, by means of the backflow preventer. Rathermore, the cartridge can also be used to advantage there where a dominant water pressure is applied to the faucet, and particularly to a single lever mixer, as a result of greatly fluctuating water pressures in the hot water or cold water system. The flow regulator in such a case evens out the flow rate per unit of time to a maximum value and facilitates the adjustment and blending of the water temperature wanted. The backflow preventer prevents that hot water is able to enter the cold water system of the water supply as a result of a dominant water pressure in the hot water system and is liable to lead to further-reaching damage of the water-using facilities, some of which are not made of heat-resistant plastic, e.g. a flushing cistern.

The synergetic co-operation of the components comprised in the cartridge can be functionally safeguarded if the cartridge has a strainer attachment arranged at the inflow end.

One advantageous embodiment of the invention proposes that the flow regulator is upstream of the backflow preventer of the cartridge, and any strainer attachment is upstream of the flow regulator, as considered in the direction of flow. As the flow regulator evens out high output, higher velocities of flow are often obtained after the flow regulator and can be reduced in the backflow preventer downstream of it in such a way that lesser noise-producing turbulences result here.

In contrast, however, it may also be expedient if, for reasons of minimizing noise and with a view to the subject matter of the invention being designed as simply as possible in structural terms, the backflow preventer is upstream of the flow regulator of the cartridge and any strainer attachment is upstream of the backflow preventer, as considered in the direction of flow.

The arrangement of the flow regulator and backflow preventer in a cartridge permits that, for certain fields of application, only the flow regulator or only the backflow preventer be accommodated in the cartridge, not that for example a different water hose or a different hose connector would have to be used. For this purpose it may be advantageous if the flow regulator, backflow preventer and also any strainer attachment take the form of separate functional inserts, if necessary replaceable ones, arranged in a common cartridge housing.

With regard to the strainer attachment, it is however also possible that, in particular, it is detachably connectable or connected to the functional insert arranged at the inflow end of the cartridge housing.

A preferred embodiment of the invention and one involving little expense to manufacture proposes that the face at the inflow end of the cartridge housing takes the form of the strainer attachment. In this embodiment, the strainer attachment is integrally connected to the cartridge housing and can, for example, be manufactured together with the latter as a plastic moulding.

It is suitable if the inside wall of the cartridge housing is provided with one support each for the flow regulator and/or backflow preventer and also for any strainer attachment. A preferred embodiment of the invention proposes that the supports are staggered and preferably take the form of annular collars staggered in steps. Particularly given an arrangement in which the supports are staggered in steps in the direction of flow, the functional inserts are seated sufficiently firmly in the cartridge housing to also be able to withstand high water pressure.

To promote a good mode of operation of the subject matter of the invention, it is advantageous if the space remaining between the outer casing of the cartridge housing on the one hand, and the inside wall of the water-supply line on the other, is sealed by means of at least one ring seal. This ring seal prevents a split stream from being able to flow through the space and past the cartridge.

The ring seal can take the form of a packing ring, for instance, which is arranged under and between a stop flange of the cartridge housing on the one hand and a face at the opening of a coupling element on the other. However, in order to keep the longitudinal extent of the cartridge as small as possible, it is advantageous if a packing ring is provided as ring seal at the outflow end zone of the cartridge housing, whereby the packing ring can be arranged, for example in an annular groove of the outer casing of the cartridge housing.

The cartridge housing can be formed with a diameter permitting the cartridge also to be fitted in existing angle valves or similar coupling points. However, a further development of the invention is preferred in which the opening of a coupling element, particularly one that is downstream of the angle valve, has a recess designed as a cartridge mount.

In order that the cartridge is also capable of withstanding high water pressures, it is advantageous if the inflow end zone of the cartridge housing is provided with a limit stop applied to the face at the opening of the coupling element. Therefore the cartridge can be inserted in the recess of the coupling element up to its limit stop, in order then to close the water-supply line again by screwing together the coupling elements provided at the coupling point or joint.

Simple handling and particularly easy removal of the cartridge is promoted if a point for application of a tool, finger nail or the like is provided at the peripheral edge or peripheral surface of the limit stop preferably in the form of an annular flange, and it the point of application particularly designed as a relief of annular groove shape is suitably bounded by the face at the opening of a coupling element. For removal of the cartridge from the water-supply line, a finger nail or tool can easily get a grip behind it at the point of application designed as a relief of annular groove shape and, for example, draw it out of the recess of the hose connector.

It is particularly advantageous if the cartridge is provided in the region of a flexible water-supply line, as is provided, for example, before a shower head or similar flexible water outlet.

A preferred embodiment of the invention proposes that the cartridge housing is detachably, but captively held in the recess in the form of a cartridge mount in the coupling element. Since the cartridge housing is detachably held in the cartridge mount, it can be removed or replaced in case of need. By virtue of the captive retention of the cartridge housing in the cartridge mount, it is simultaneously ensured that the cartridge is not inadvertently lost during fitting and is unable to carry out the intended functions.

It is advantageous in this connection if the outer peripheral casing of the cartridge housing is provided with a retaining device which is preferably spaced from both housing ends and co-operates with a companion retainer on the inside wall of the recess, and if the connection brought about between the retaining device and the companion retainer can be overcome by a rotary motion and/or pulling force. The retaining device may, for example, take the form of an externally threaded portion which is provided on the peripheral casing of the cartridge housing and co-operates with an internally threaded portion on the inside wall of the recess. An especially simple and advantageous embodiment of the invention proposes, however, that the retaining device or the companion retainer is formed by at least one retaining lug co-operating with at least one retaining projection and that the retaining and/or the retaining projection is/are of circumferential annular design. Since the retaining device is provided on, and spaced from the ends of, the cartridge housing, the cartridge housing can initially be pushed out of the recess up to the point where the retaining device strikes against the companion retainer. By means of a preferably defined pulling force and/or by means of a rotary motion of the cartridge housing relative to the coupling element, the detachable connection between these elements can then be overcome and the cartridge housing can finally be removed from the cartridge mount. Although the cartridge is captively held in the cartridge mount, it can be removed and replaced easily and with little effort in case of need.

In this embodiment, a ring seal provided between the outer casing of the cartridge housing on the one hand, and the inside wall of the water-supply line on the other, might check the freedom of the cartridge housing to slide in the cartridge mount. Therefore, it may be advantageous here if the cartridge housing is insertable in the recess as far as a stop and if the cartridge housing preferably has a sealing rim, particularly an annular one, arranged generally in-plane with the face at the inflow end of the coupling element. In this embodiment, the space provided between the cartridge housing and the cartridge mount can be sealed for instance by a packing ring which bears against the opening edge at the inflow end of the coupling element and extends radially up to the sealing rim of the cartridge housing.

To attain double operational dependability, particularly in the function stopping backflow displayed by the cartridge according to the invention, it may be expedient if in the cartridge housing there are at least two backflow preventers provided, arranged between which is a flow regulator.

Further features of the invention follow from the description below of exemplary embodiments of the invention, taken in conjunction with the claims and drawings. The individual features may be realized singly or severally in an embodiment of the invention.

Figure 2:
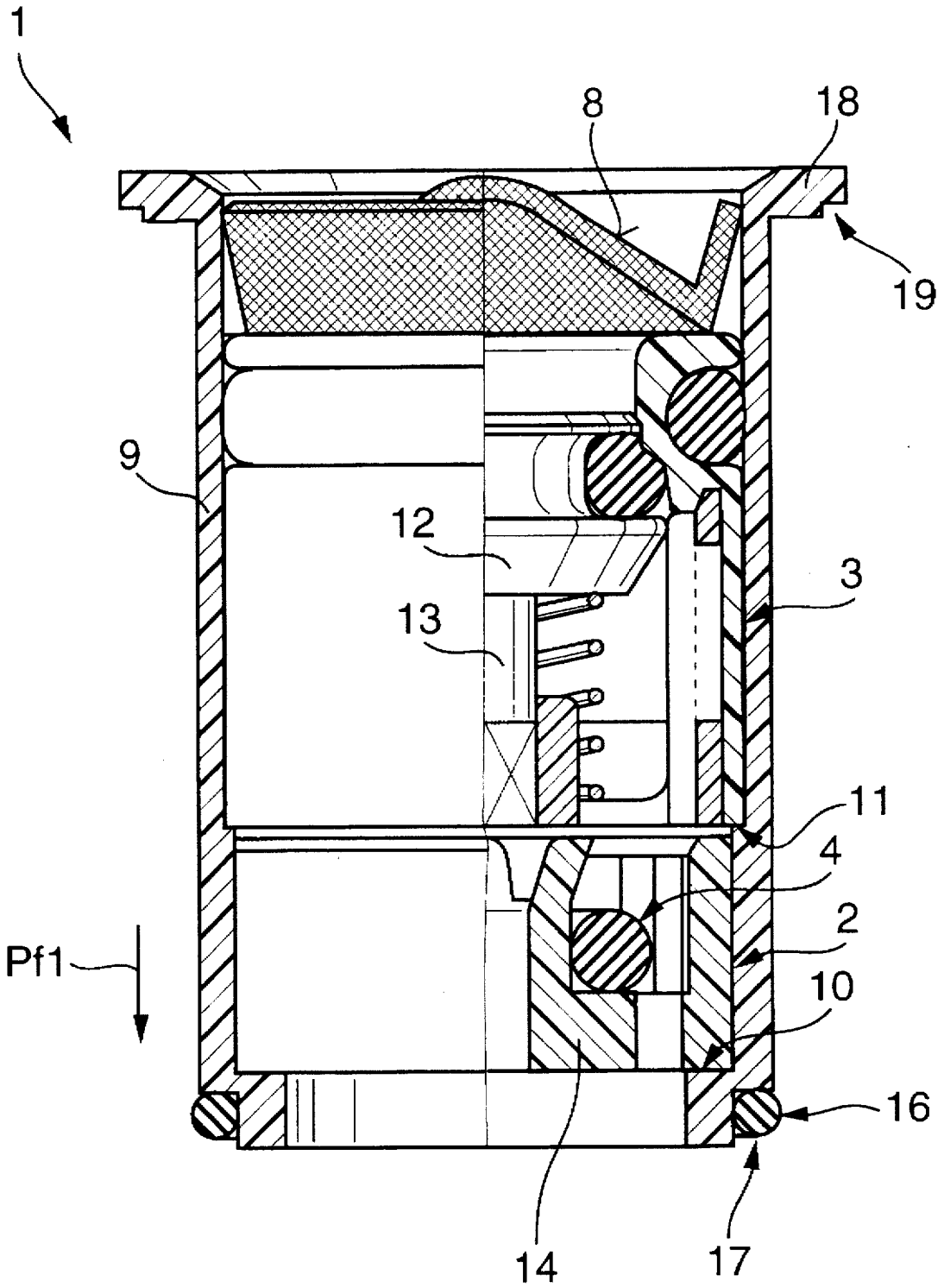
Figure 3:
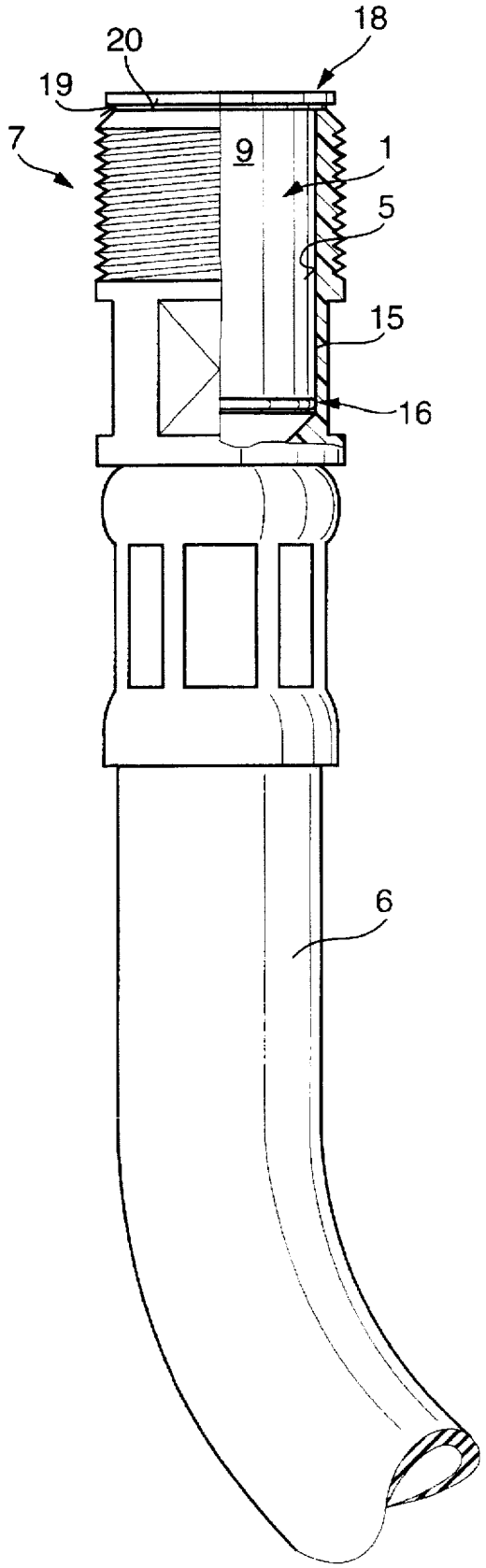
Figure 4:
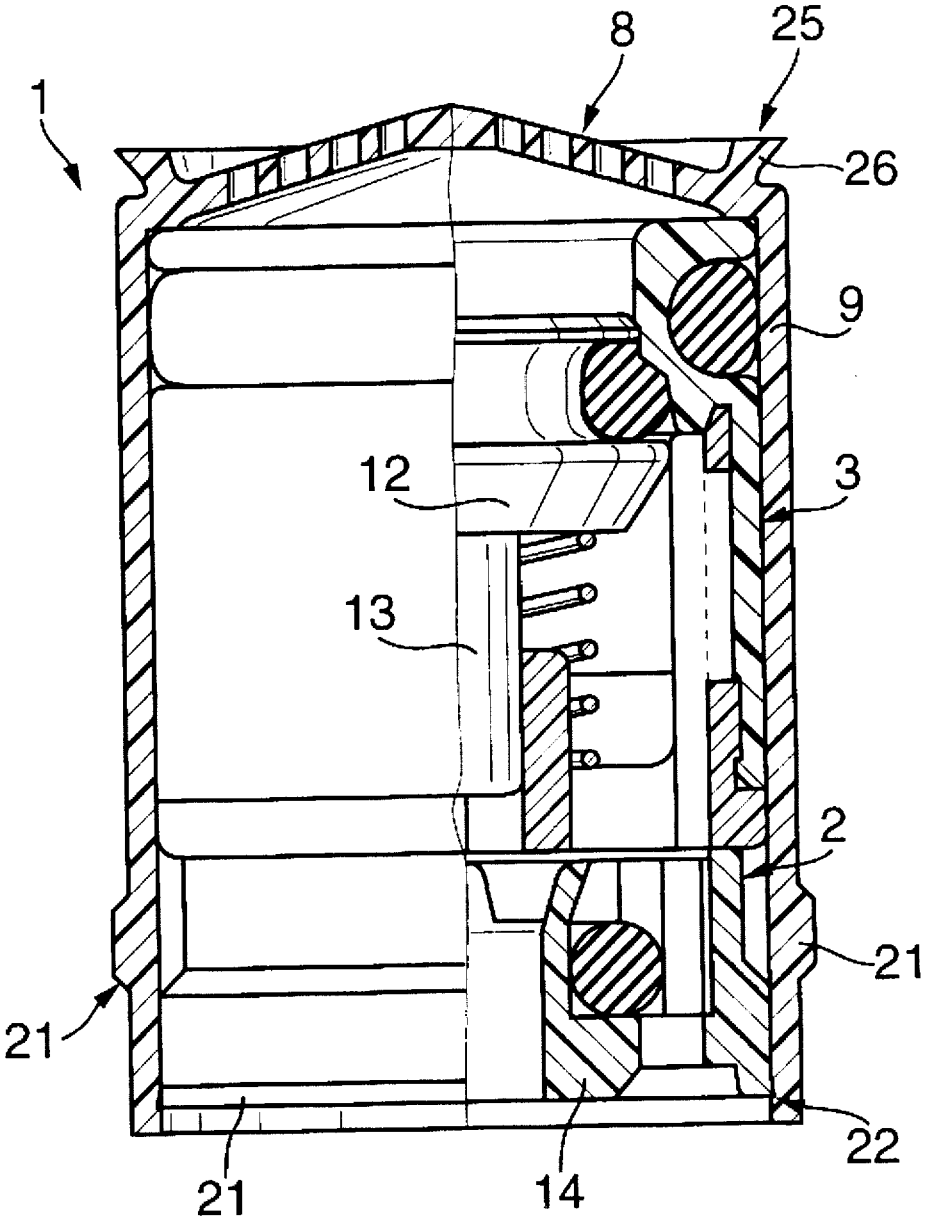
Figure 5:
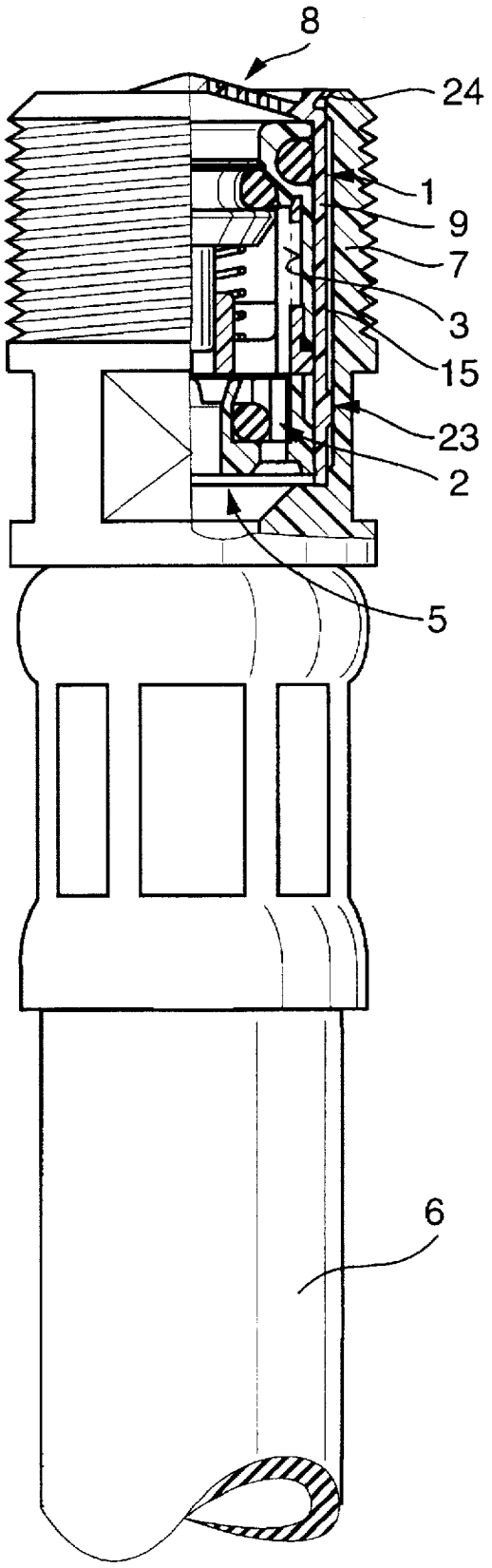
Figure 6:
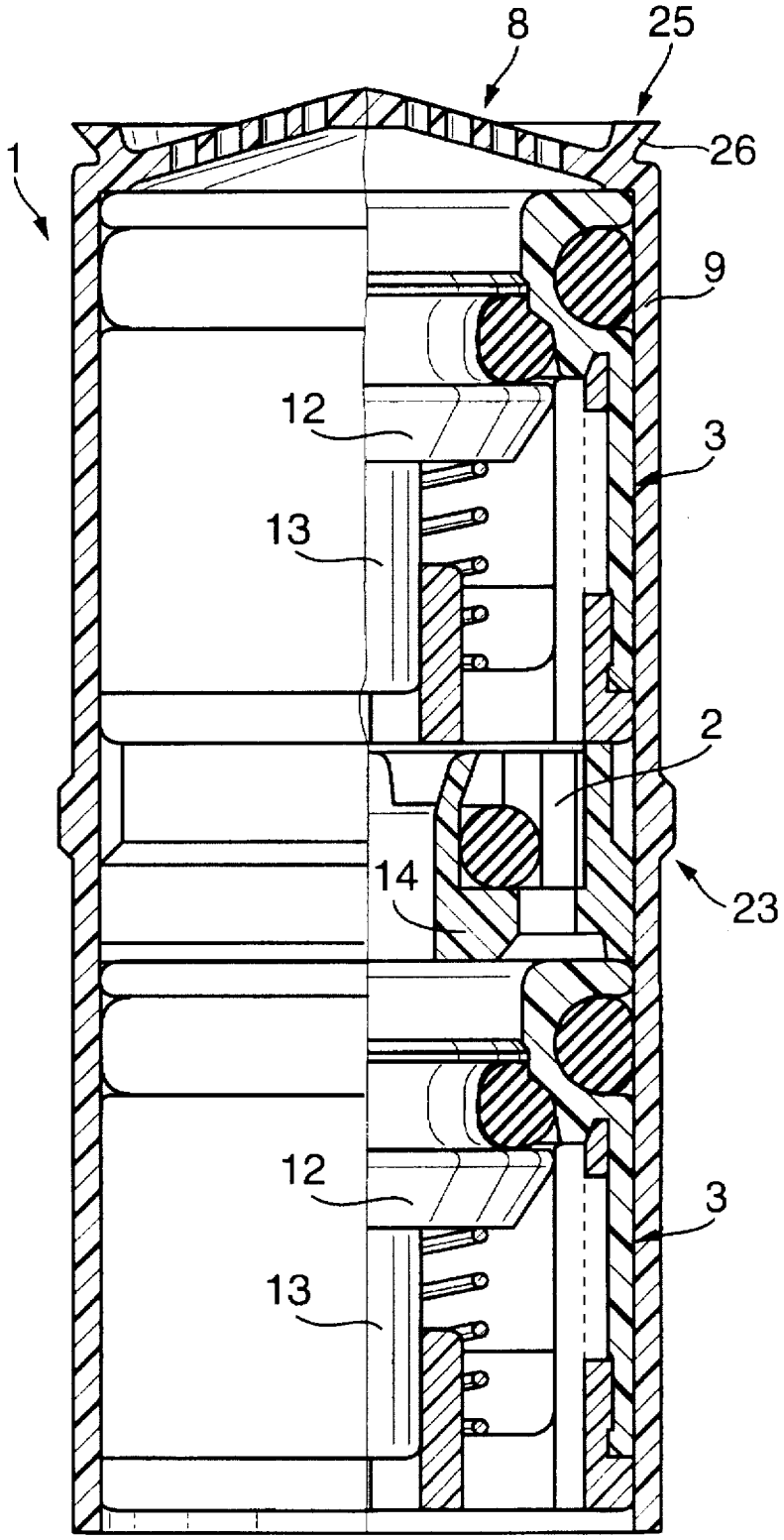
Figure 7:
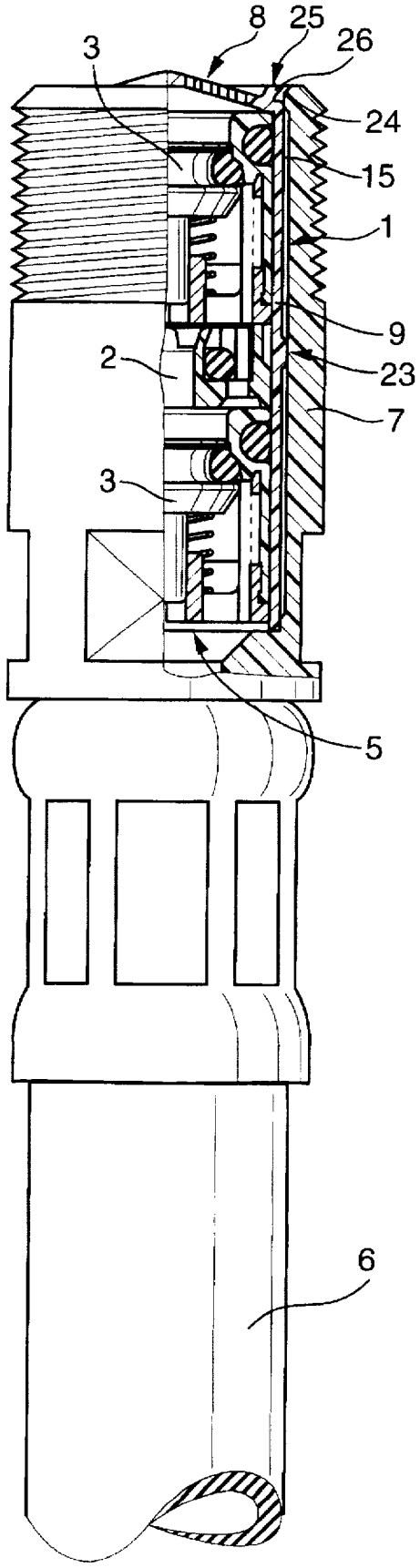

In the drawings,

FIG. 1 is a partly sectional view of a sanitary safety device which combines a flow regulator and a backflow preventer with a strainer attachment at the inflow end to form a constructional unit in the form of a cartridge, FIG. 2 is a cartridge, similar to that of FIG. 1, whereby here however the backflow preventer is upstream of the flow regulator in the direction of inflow, FIG. 3 is the cartridge of FIGS. 1 or 2 in the recess forming the cartridge mount in a hose connector provided on a flexible water hose, FIG. 4 is a sectional view of a cartridge similar to that of FIG. 1, FIG. 5 is the cartridge of FIG. 4 in the recess forming the cartridge mount in a hose connector provided on a flexible water hose, FIG. 6 is a sectional view of a cartridge having in its housing two backflow preventers, arranged between which is a flow regulator, and FIG. 7 is the cartridge of FIG. 6 in the cartridge mount of a hose connector provided on a flexible water hose.

FIGS. 1 and 2 depict two different designs of a flow regulator 2 having a rubber ring 4 or similar elastomeric component which adjusts the clear cross section of the flow regulator 2 and thus its output per unit of time to a defined maximum value in dependence on the water pressure. As becomes clear from comparing FIGS. 1 and 2 on the one hand and FIG. 3 on the other, the flow regulator 2 is combined with a backflow preventer 3 to form a constructional unit in the form of a cartouche or cartridge 1. This unit composes a sanitary safety device and is insertable in the opening of a recess 5 forming a cartridge mount in a hose connector 7 provided on a flexible water hose 6. The hose connector 7 serves as a coupling element for coupling the water hose 6 to a coupling point or joint interposed in the water-supply line.

The cartridge 1 has at the inflow end a strainer attachment 8 of generally W-shaped cross section. The strainer attachment 8 keeps any particles of dirt in the water current away from the flow regulator 2 and backflow preventer 3 and in this respect is to ensure that their operation is not impaired.

It may be noted from FIGS. 1 and 2 that the flow regulator 2, backflow preventer 3 and strainer attachment 8 are each in the form of separate functional inserts and are adapted in shape so as to be insertable in a common housing 9 of the cartridge 1.

For this purpose, the cartridge housings 9 in FIGS. 1 and 2 have in each case at least one support 10 which takes the form of an annular collar or annular shoulder and is provided on the inside wall of the housing in the region of the outflow end zone.

Whereas in FIG. 1 the functional inserts 2, 3, 8 resting upon one another are supported at 10, in the cartridge housing 9 of FIG. 2 two supports 10, 11 staggered in steps are provided. While in FIG. 2 the flow regulator 2 is arranged on the annular collar 10 at the outflow end, the backflow preventer 3 is held by an annular collar 11 spaced therefrom in the direction of inflow. In FIGS. 1 and 2 the strainer attachment is seated on the functional insert 2 or 3, respectively, in the direction of inflow and might also be fastened thereto in a preferably detachably lockable or similar fashion.

The flow regulator 2, backflow preventer 3 and strainer attachment 8 are of standard design and may also be of a design unlike the exemplary embodiments shown here.

In FIG. 1, the flow regulator 2 is upstream of the backflow preventer 3 of the cartridge 1 and the strainer attachment 8 is upstream of the flow regulator 2, as considered in the direction of flow Pf1. As the flow regulator 2 may also have to cope with high output, higher velocities of flow are often obtained in the direction of outflow downstream of the flow regulator 2 and can be reduced in the backflow preventer 3 downstream of it in such a way that the cartridge 1 according to FIG. 1 is distinguished by lesser noise-producing turbulences.

In the case of the cartridge depicted in FIG. 2, the backflow preventer 3 is upstream of the flow regulator 2 and the strainer attachment 8 is upstream of the backflow preventer 3, as considered in the direction of flow. This embodiment according to FIG. 2 can be particularly advantageous if the cartridge 1 is to be kept as small as possible. As becomes apparent from FIG. 2, the guide pin 13 provided at the valve cone 12 of the backflow preventer 3 may enter a regulating core that forms part of the flow regulator 2 and is surrounded by the rubber ring 4.

At the cartridge housing 9 according to FIGS. 1 to 3, the space 15 remaining between the outer casing of the cartridge housing 9 on the one hand, and the inside wall of the water-supply line on the other, is sealed by means of at least one ring seal. Here the ring seal takes the form of a packing ring 16 which is provided at the outflow end zone of the cartridge housing 9 and is situated in an external annular groove 17 of the cartridge housing 9.

As is manifest from FIGS. 1 and 2, the inflow end zone of the cartridge housing 9 is provided with a limit stop 18, here in the form of an annular flange, which is applied to the face at the opening of the coupling element provided at the inflow end of the hose connector of the water hose 6. The cartridge 1 can hence be inserted in the opening of the recess 5 provided in the hose connector 7 or similar coupling element of the water hose 6 and be slipped in as far as the limit stop 18. In addition, a point of application 19 designed as a relief of annular groove shape is provided at the peripheral edge of the limit stop 18 and a finger nail or tool can easily get a grip behind it for detaching and drawing the cartridge 1 out of the hose connector 7.

The arrangement of the flow regulator 2 and backflow preventer 3 in the cartridge 1 permits that, for certain fields of application, only the flow regulator 2 or only the backflow preventer 3 be accommodated in conjunction with the strainer attachment 8 in the cartridge housing 9, if for example a different water hose 6 or a different hose connector 7 would have to be used. At the same time, the cartridge 1 can be interposed in a simple fashion and with little effort in the water-supply line also formed by the water hose 6, the limit stop 18 being fixed between the faces at the openings of the coupling elements composing the coupling point or joint.

FIGS. 4 and 5 as well as 6 and 7 each show a cartridge 1 which—similarly as in FIGS. 1 to 3—combine a flow regulator 2 and at least one backflow preventer 3 in a common cartridge housing 9 to form a constructional unit. In FIGS. 4 to 7, the face at the inflow end of the cartridge housing 9 takes the form of a strainer attachment 8. The strainer attachment 8 thus integrally connected to the cartridge housing 9 in FIGS. 4 to 7 can be produced together with the latter as a plastic moulding.

As FIGS. 4 to 7 show, the flow regulators 2 and backflow preventers 3 of the cartridges 1 are inserted in the cartridge housing 9 from the open face opposite the strainer attachment 8 in such a way that in each case a backflow preventer 3 is upstream of the flow regulator 2, as considered in the direction of flow. In addition, a guide pin 13 is provided at the valve cone 12 adjustable against a restoring force and can enter a guide opening in the regulator core 14 of the downstream flow regulator 2. Therefore the cartridges 1 according to FIGS. 4 to 7 are also distinguished by a compact and space-saving design.

In the case of the cartridges 1 shown in FIGS. 6 and 7, the functional units 2, 3 are held with friction-locking engagement in the cartridge housing 9. In contradistinction, in the case of the cartridge 1 according to FIGS. 4 and 5, a circumferential locking lug 23 is provided on the last functional unit 2 in the direction of flow and engages with a locking recess 22 in the inside periphery of the cartridge housing 9 for form-locking anchorage of this functional unit.

The cartridges 1 in FIGS. 4 to 7 are also inserted in a recess 5 designed as a cartridge mount provided at the opening of the hose connector 7 that serves as a coupling element and belongs to a flexible water hose 6.

In comparing FIGS. 4, 5 and 6, 7 it becomes clear that the cartridges 1 depicted there are held detachably, but nevertheless captively, in the recess 5 serving as cartridge mount. For this purpose, the cartridge housings 9 of the cartridges 1 depicted in FIGS. 4 to 7 are provided with a retaining lug 23 which runs in a ring shape round the cartridge housing 9 and is arranged spaced from both housing ends. This retaining lug 23 on the cartridge casing 9 co-operates with a likewise ring-shaped retaining projection on the inside wall of the hose connector 7 defining the recess 5. Since the cartridge housing 9 is provided with the retaining lug 23 in spaced relationship to the housing ends, the cartridge housings 9 depicted in FIGS. 4 to 7 can be pushed so far out of the recess 5 until the retaining lug 23 strikes the retaining projection 24 arranged in the opening area of the recess 5. By applying a manual pulling force of for example at least 36 Newton, the releasable connection between the retaining lug 23 of the cartridge housing 9 and the opposite retaining projection 24 of the coupling element 7 can be overcome and the cartridge housing 9 can be finally removed from the recess 5. By virtue of this easily releasable, but nevertheless captive retention of the cartridge housing 9 in the cartridge mount 5, it is ensured that the cartridges 1 depicted in FIGS. 4 to 7 are not inadvertently lost during fitting and are unable to carry out the functions wanted.

As becomes apparent from FIGS. 5 and 7, the cartridges 1 shown there are insertable in the cartridge mount up to the recess base serving as stop. The cartridge housing 9 is provided with an annular sealing rim 25 formed by a projection 26 which protrudes from the face at the inflow end of the cartridge housing 9 and flares outwardly counter to the direction of flow. The sealing rim 25 is arranged generally in-plane with the face at the inflow end of the hose connector 7, so that a space 15 remaining between the cartridge housing 9 and the recess 5 can be tightly closed by a sealing ring which is provided at the opening, but is not shown here.

As becomes apparent from FIGS. 6 and 7, the cartridges 1 depicted there have two backflow preventers 3 which provide double dependability of the function stopping backflow. The flow regulator 2 is arranged between the backflow preventers 3 acting counter to the direction of flow.

In FIGS. 3, 5 and 7, the hose connectors 7 serving as coupling element each have an external thread onto which a sleeve nut (not shown) in the form of a companion coupling element provided, for example, on an angle valve or preferably on a faucet outlet can be screwed for sealing the water-supply line.

What is claimed is:

1. A flow-control cartridge for insertion into a tubular conduit comprising:

a. a cylindrical tubular housing having a uniform inside diameter and having an upstream end and a downstream end and an outward peripheral rib adapted to center the housing in the tubular conduit, b. a plurality of separate and independently structured cylindrical flow-control insert elements, each having the same outside diameter as the inside diameter of the housing and disposed snugly in stacked relation inside the tubular housing, the insert elements comprising:

(1) a backflow preventor comprising a first annular body having an upstream end and downstream end and having a valve seat at its upstream end, a spider unitary with the first annular body and having a central tubular hub at the downstream end and a valve element comprising a head disposed adjacent the valve seat and a stem extending slidably in the tubular hub, and a spring disposed around the stem and between the spider and the head and biasing the head toward the seat, and (2) a flow restrictor comprising a second annular body formed with a central opening and a concentric annular trough facing the upstream end of the tubular housing, the trough having an inner margin, the second annular body having ports therethrough arranged outward from the inner margin and a resilient O-ring disposed in the trough normally adjacent the inner margin and adapted under pressure to expand outward to partly cover the ports and restrict flow, c. inward retaining means in the housing for retaining the insert elements from moving axially of the housing.

2. In combination with the flow-control cartridge of claim 1 the tubular conduit having an upstream end, the conduit receiving the flow-control cartridge, the outward peripheral rib on the housing engaging about the inside of the tubular conduit, and inward retaining means on the tubular conduit retaining the flow-control cartridge from axial movement in the tubular conduit.

3. The combination of claim 2 wherein the inward retaining means is a retaining inward projection at the upstream end of the tubular conduit.

4. A flow-control cartridge as claimed in claim 1 wherein one of the inward retaining means in the housing for retaining the insert elements is a domed screen.

5. A flow-control cartridge as claimed in claim 3 wherein the domed screen is integral with the housing.

6. A flow-control cartridge as claimed in claim 1 wherein the stem from the backflow preventor can extend into the central opening in the flow restrictor.

7. A flow-control cartridge for insertion into a tubular conduit comprising:

a. a cylindrical tubular housing having a plurality of inside diameter portions and having an upstream end and a downstream end and an outward peripheral element adapted to center the housing in the tubular conduit, b. a plurality of separate and independently structured cylindrical flow-control insert elements having respectively the same outside diameter as the inside diameter of the portions and disposed snugly in stacked relation inside the respective portions, the insert elements comprising:

(1) a backflow preventor comprising a first annular body having an upstream end and downstream end and having a valve seat at its upstream end, a spider unitary with the first annular body and having a central tubular hub at the downstream end and a valve element comprising a head disposed adjacent the valve seat and a stem extending slidably in the tubular hub, and a spring disposed around the stem and between the spider and the head and biasing the head toward the seat, and (2) a flow restrictor comprising a second annular body formed with a central opening and a concentric annular trough facing the upstream end of the tubular housing, the trough having an inner margin, the second annular body having ports therethrough arranged outward from the inner margin and a resilient O-ring disposed in the trough normally adjacent the inner margin and adapted under pressure to expand outward to partly cover the ports and restrict flow, c. inward retaining means in the housing for retaining the insert elements from moving axially of the housing.

* * * * *